US007004885B1

(12) United States Patent
Wu et al.

(10) Patent No.: US 7,004,885 B1
(45) Date of Patent: Feb. 28, 2006

(54) WHEELCHAIR TRAINING PLATFORM

(75) Inventors: Hong-Sheng Wu, Yunlin (TW); Jhong-Jie Chen, Tai-Chung (TW); Wei-Long Chen, Tai-Chung (TW)

(73) Assignee: Taiwan Bicycle Industry R8 D Center, Taichung (TW)

( * ) Notice: Subject to any disclaimer, the term of this patent is extended or adjusted under 35 U.S.C. 154(b) by 0 days.

(21) Appl. No.: 11/080,259

(22) Filed: Mar. 15, 2005

(51) Int. Cl.
*A63B 22/00* (2006.01)

(52) U.S. Cl. ..... 482/4; 482/8; 482/51; 482/54; 482/900

(58) Field of Classification Search ..... 482/1–9, 482/51, 54, 900–902
See application file for complete search history.

(56) References Cited

U.S. PATENT DOCUMENTS 5,649,883 A * 7/1997 Mayes et al. ..... 482/54
5,704,876 A * 1/1998 Baatz ..... 482/4
6,113,519 A * 9/2000 Goto ..... 482/54

* cited by examiner

*Primary Examiner*—Glenn E. Richmon
(74) *Attorney, Agent, or Firm*—Charles E. Baxley

(57) ABSTRACT

In a wheelchair training platform, a wheelchair is connected to a computer system through the training platform, and the training platform detects signals of a rotary speed and a forward direction or a reverse direction of two rear wheels of the wheelchair, and sends the signals to a computer system. The computer system reflects the foregoing rotary speed and direction to a virtual reality interactive software/game, such that the wheelchair has an interaction with the virtual reality interactive software/game.

14 Claims, 4 Drawing Sheets

WHEELCHAIR TRAINING PLATFORM

BACKGROUND OF THE INVENTION

1. Field of the Invention

The present invention generally relates to training and therapy platforms, and more particularly relates to a wheelchair training platform that connects a training platform with a computer system, and the training platform detects a rotary speed of two rear wheels of a wheelchair and a forward direction or a reverse direction of the wheelchair, and sends the detected signals of the rotary speed and direction to the computer system, and the computer system reflects the rotary speed and direction on a virtual reality interactive software/game to produce interactions between the wheelchair and the virtual reality interactive software/game.

2. Description of the Related Art

Wheelchair is a very important transportation means for handicaps and people with walking problems, but most wheelchair users are usually using a wheelchair without any psychological preparation or even operating the wheelchair without knowing the operation of a wheelchair. Under the conditions of unfamiliar operations, a wheelchair user bears a heavy psychological burden which may endanger the user or others. Therefore, most physical therapists recommend wheelchair users to have sufficient practices before using the wheelchair. However, users often have no appropriate place and equipment for such practices. For example, although a user can practice on driving a wheelchair in a forward direction, a reverse direction, or making turns on a floor of a familiar indoor environment, the practices cannot prepare the user for outdoor rough road conditions, uphill or downhill operations, as well as emergency dodges. It is unquestionable that operating a wheelchair in an outdoor environment without knowing its operations thoroughly is very dangerous.

In addition, handicaps or patients with walking problems usually are not willing to practice the use of a wheelchair for many reasons, and thus their muscle strength, heart and lung functions and physical strength may become deteriorated rapidly. To prevent the problem above, a comfortable, natural, convenient and safe exercise environment is very important for the wheelchair user's practices. These exercise environments can be provided for the use by general wheelchair users as well as the training for wheelchair athletes.

SUMMARY OF THE INVENTION

A primary objective of the present invention is to provide a training platform for placing a wheelchair thereon, and the training platform detects signals of a rotary speed, a forward direction, or a reverse direction of two rear wheels of the wheelchair, and sends such signals to a computer system. The computer system will reflect the foregoing rotary speed and direction to a virtual reality interactive software/game, and thus the wheelchair has an interaction with the virtual reality interactive software/game as well as achieving the purpose of training wheelchair users.

To achieve the foregoing technical solution, the present invention comprises a wheelchair training platform for placing a wheelchair, and the wheelchair training platform is connected with a computer system; and the wheelchair platform comprises:

- a training platform, having a platform and an aslant board for guiding the foregoing wheelchair onto the platform;
- a front wheel fixture, installed on the training platform for fixing the front wheel of the wheelchair; and

- two sets of control mechanisms, installed on the training platform, so that two rear wheels of the wheelchair are rotably and respectively connected to the two control mechanisms, and each control mechanism measures a rotary speed, and a forward direction or a reverse direction of a rear wheel and sends such information to the computer system.

DETAILED DESCRIPTION OF THE PREFERRED EMBODIMENTS

Figure 1:
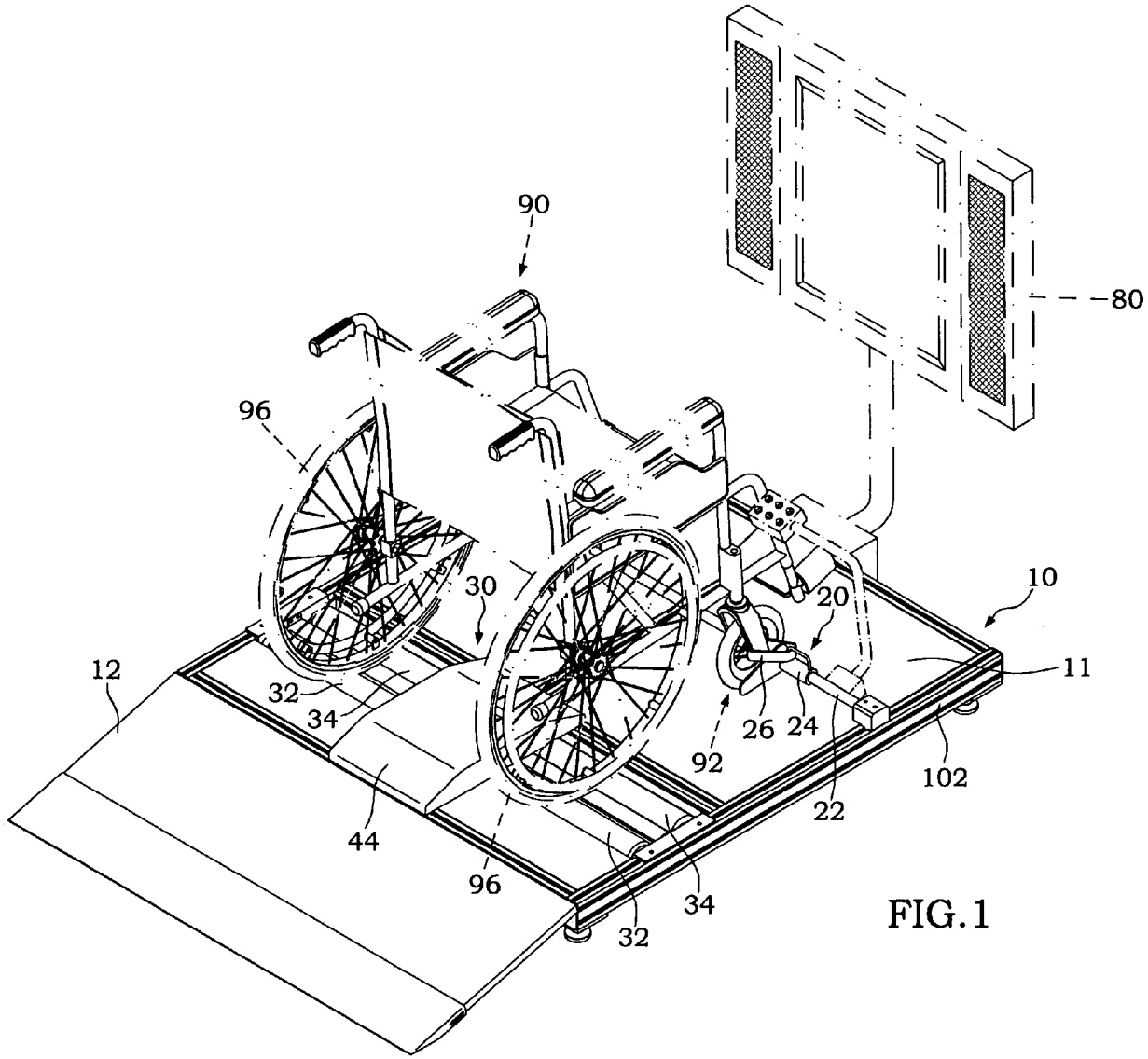
FIG. 1 is a perspective view of combining a training platform with a wheelchair in accordance with the present invention.
Figure 2:
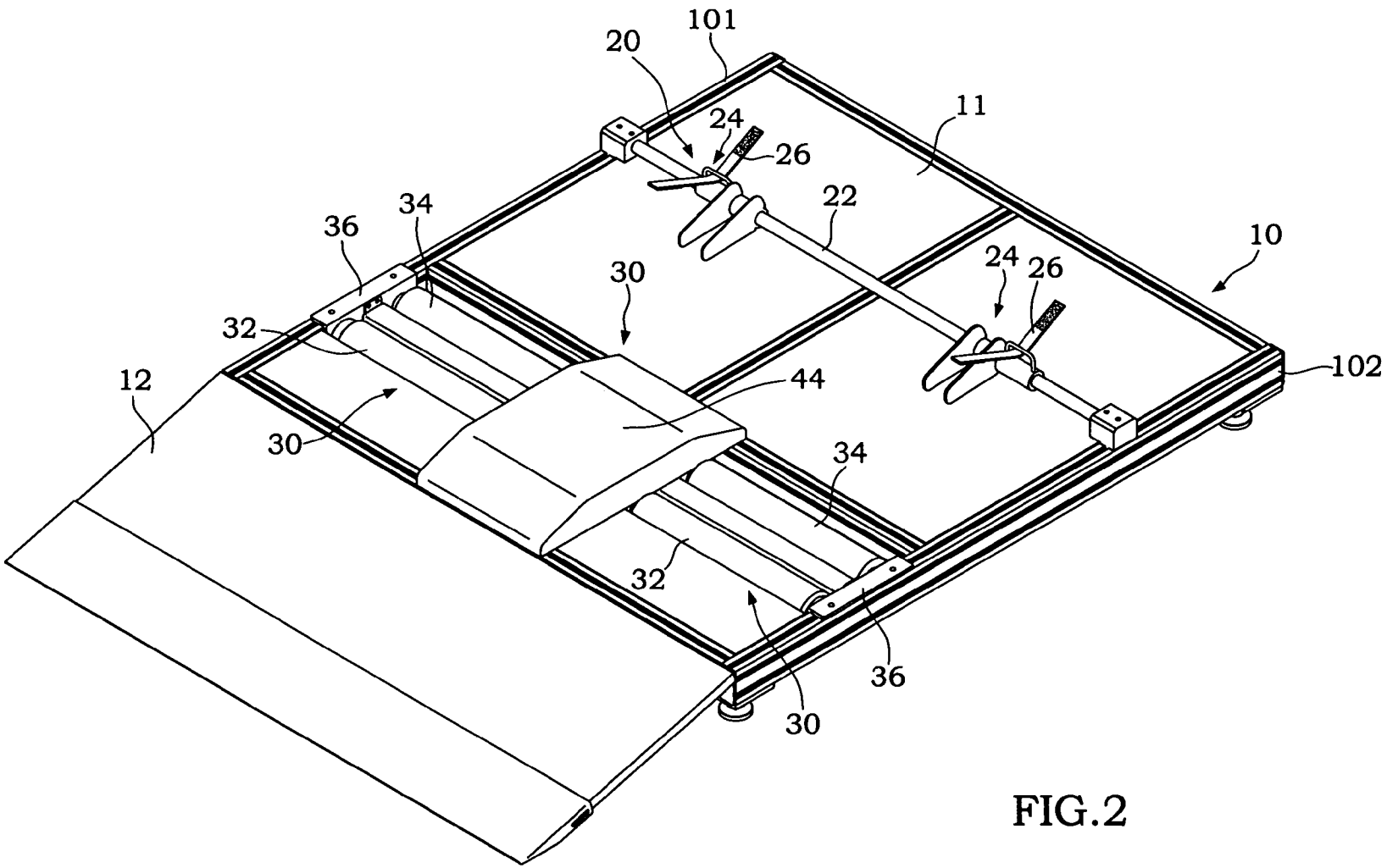
FIG. 2 is a perspective view of a training platform in accordance with the present invention.

Referring to FIGS. 1 and 2, a wheelchair training platform in accordance with the present invention comprises:

- a training platform 10, having a platform 11 and an aslant board 12 for guiding a wheelchair 90 onto the platform 11;
- a front wheel fixture 20, installed on the training platform 10 for fixing a front wheel 92 of the wheelchair 90; and
- two sets of control mechanisms 30, installed on the training platform 10 and aligned linearly with the front wheel fixture 20, and two rear wheels 96 of the wheelchair 90 are rotably and respectively connected to the two control mechanisms 30, so that a user can sit on the wheelchair 90 to operate the rotation of the rear wheels 96, and each control mechanism 30 measures a rotary speed and a forward direction or a reverse direction of the rear wheel 96 and sends such information to the computer system 80.

Referring to FIGS. 1 and 2, the foregoing front wheel fixture 20 comprises:

At least one axle 22, for moving and being fixed along the left and right sides 101, 102 of the training platform 10, and the axle 22 has two sets of front wheel fixtures 24 for moving and being fixed along an axial direction of the axle 22, and each front wheel fixture 24 can clamp a front wheel 92 of the wheelchair 90, and the front wheel fixture 24 further includes a brake 26 for stopping the rolling of the front wheel 92, and the brake 26 as shown in the figure is an object similar to mother-daughter adhesive tapes for wrapping around the front wheel 92 and stopping the rotation of the front wheel 92.

Figure 3:
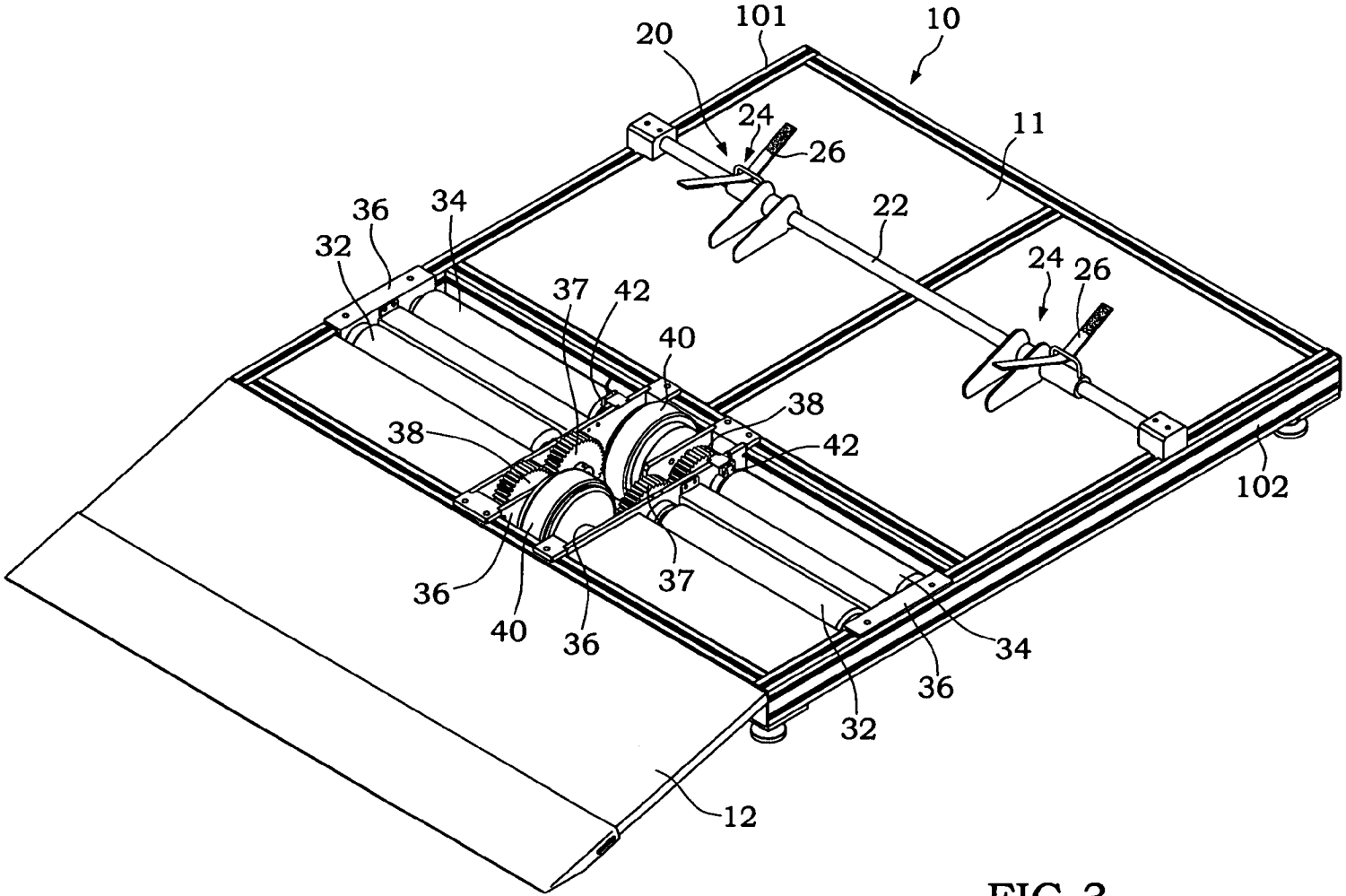
FIG. 3 is a perspective view of a training platform and a structural mode of a control mechanism in accordance with the present invention.
Figure 4:
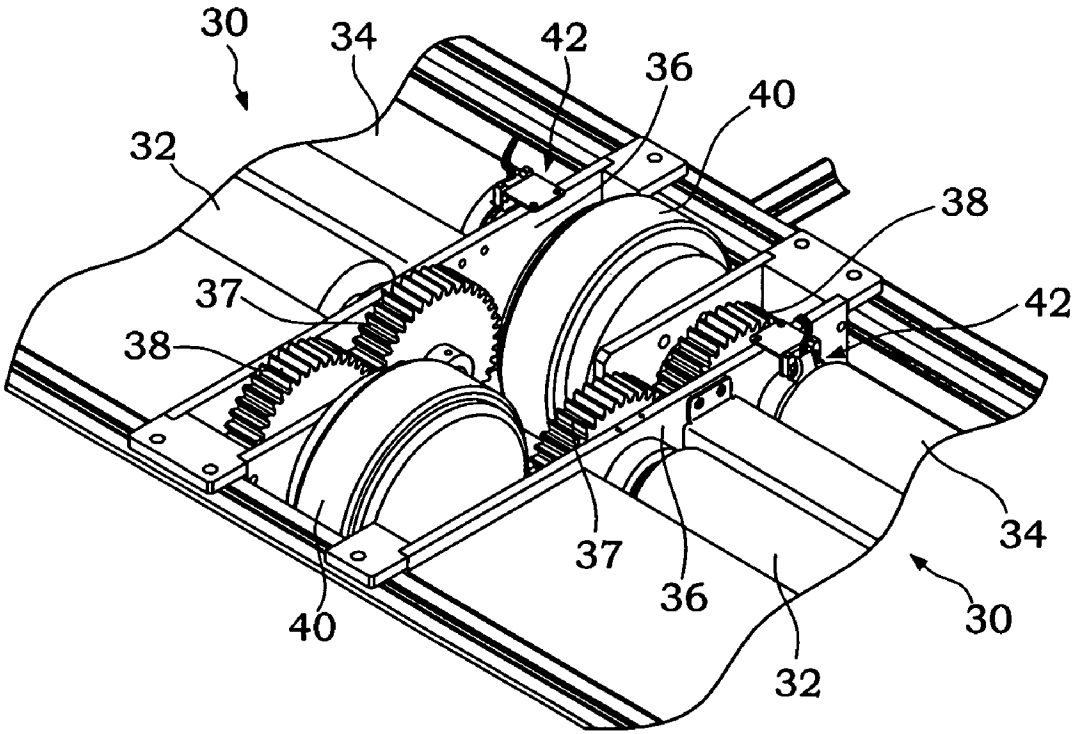
FIG. 4 is a perspective view of a section of a control mechanism in accordance with the present invention.

Referring to FIGS. 2 to 4, each control mechanism comprises:

- two rolling wheels 32, 34, and both ends of an axle of each rolling wheel can be rotably fixed onto a wheel fixing board 36, and the wheel fixing board 36 can be shifted along the left and right sides 101, 102 of the training platform 10 and fixed in a predetermined position, and the two rolling wheels 32, 34 support a rear wheel 96 of the wheelchair 90;

a first and a second corresponding gears 37, 38, axially coupled with each other;

a braking device 40, axially coupled to the second gear 38 and electrically coupled to the computer system 80, and the computer system 80 controls the operation of the braking device 40 and the braking force applied onto the gear 38; and a speed and direction detector 42, for detecting a rotary speed and a forward direction or a reverse direction of a rolling wheel 34, and the detected signals of the rotary speed and direction signals are sent to the computer system 80.

The training platform 10 has two sets of control mechanisms 30 for measuring the two rear wheels 96 of the wheelchair 90. The two control mechanisms 30 are installed on the training platform 10 by means of the corresponding gear sets 37, 38 and the braking device 40, and a hood 44 is installed on the training platform 10 at the positions of the gears 37, 38 and the braking device 40.

The front wheels 92 of the wheelchair 90 are limited by the front wheel fixture 20 and cannot be rotated or moved. If the rear wheels 96 rotate, the two rolling wheels 32, 34 are also driven to rotate, and the speed and direction detector 42 detects a rotary direction (which refers to a clockwise rotation or a counterclockwise rotation) and a rotary speed of one of the rolling wheels 34, and then the direction and rotary speed signals are outputted to the computer system 80. The computer system 80 computes and analyzes the direction and rotary speed signals and reflects the information to a virtual reality interactive software/game installed in the computer system 80 to change the virtual reality roles of the wheelchair in the interactive program for its speed and forward or reverse movements. In addition to the forward and reverse directions, the computer system 80 also can compute and analyze different rotary speeds or different rotary directions of two speed and direction detectors 42. The difference of the speeds or different rotary directions can be analyzed further to compute a left turn angle or a right turn angle, and these results are reflected to the interactive software/game, so that the virtual reality roles are the changes of a left turn, a right turn or a turn with different angles.

The computer system 80 further controls the braking device 40 according to the road conditions such as uphill, downhill, rough roads set in the program. The braking device 40 provides an appropriate resistance to the rolling wheels 32, 34 through the gear sets 37, 38, and thus can change the rotary resistance and speed of the rear wheels 96 of the wheelchair 90.

The training platform 10 of the present invention uses its control mechanism 30 to connect the wheelchair 90 with the virtual reality interactive software or game of the computer system 80 and the virtual reality interactive software or game simulates various real conditions, so that users can practice their use of a wheelchair in a comfortable, natural, convenient and safe environment to improve muscle strength, heart and lung functions, and the like. The invention even can train wheelchair athletes for special games. During a physical therapy or training process, a user may use the multimedia effects of the virtual reality interactive software/game to improve the fun of the training.

The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wheelchair training platform, for placing a wheelchair thereon, and said wheelchair training platform coupled with a computer system, comprising:

a training platform, having a platform and an aslant board for guiding said wheelchair onto said platform;

a front wheel fixture, installed on said training platform for fixing a front wheel of the wheelchair; and two sets of control mechanisms, installed on said training platform and aligned linearly with said front wheel fixture, and two rear wheels of said wheelchair being rotably and respectively coupled with said two control mechanisms, and said each control mechanism measures a rotary speed and a forward direction or a reverse direction of said rear wheel and sends said rotary speed and said forward direction or said reverse direction to said computer system.

2. The wheelchair training platform of claim 1, wherein said front wheel fixture is shifted and adjusted according to the size of said training platform.

3. The wheelchair training platform of claim 2, wherein said front wheel fixture comprises at least one axle being shifted, adjusted and fixed along the left and right sides of said training platform; and two sets of front wheel fixing devices being fixed onto said front wheels of said wheelchair.

4. The wheelchair training platform of claim 3, wherein said front wheel fixing device includes a brake for stopping the rotation of said front wheel of said wheelchair.

5. The wheelchair training platform of claim 4, wherein said brake is coupled to an adhesive tape disposed on said front wheel fixing device.

6. The wheelchair training platform of claim 1, wherein said two control mechanism is shifted and adjusted according to the size of said training platform.

7. The wheelchair training platform of claim 6, wherein said two control mechanisms are shifted, adjusted and fixed along the left and right sides of said training platform.

8. The wheelchair training platform of claim 1, wherein said each control mechanism comprises at least two rolling wheels; a speed and direction detector for measuring a rotary speed of one of said rolling wheels and detecting a rotary direction of said rolling wheel; and said two rolling wheels are driven by said one rear wheel of said wheelchair.

9. The wheelchair training platform of claim 8, wherein said each control mechanism further comprises a braking device for controlling a rotary resistance of said rolling wheels.

10. The wheelchair training platform of claim 9, wherein said braking device is turned on, turned off, or applied with a rotary resistance to said rolling wheel by the control of said computer system.

11. The wheelchair training platform of claim 10, wherein said braking device is coupled with said one rolling wheel through two corresponding gears.

12. The wheelchair training platform of claim 11, wherein said one gear is axially coupled with said one rolling wheel and said other gear is axially coupled with said braking device.

13. The wheelchair training platform of claim 12, wherein said two control mechanisms are installed on said training platform by means of said gear set and said braking device, and said training platform includes a hood for covering said gears and said braking device.

14. The wheelchair training platform of claim 1, wherein said computer system receives a rotary speed signal and a direction signal produced by said control mechanism, and said rotary speed and direction signals are reflected on a virtual reality interactive software installed in said computer system.

* * * * *